United States Patent [19]

Barker

[11] Patent Number: 4,649,715

[45] Date of Patent: Mar. 17, 1987

[54] AIR CONDITIONED APRON

[76] Inventor: Stanley G. Barker, 607 Madison St., Joliet, Ill. 60435

[21] Appl. No.: 853,643

[22] Filed: Apr. 18, 1986

Related U.S. Application Data

[63] Continuation-in-part of Ser. No. 749,501, Jun. 27, 1985, abandoned.

[51] Int. Cl.[4] ..... F25D 23/12

[52] U.S. Cl. ..... 62/259.1; 2/48

[58] Field of Search ..... 2/2, 48, 46; 62/259.3; 126/204; 165/46

[56] References Cited

U.S. PATENT DOCUMENTS 3,085,405 4/1963 Frantti ..... 62/259.3

3,174,300 3/1965 Webb ..... 62/259.3

*Primary Examiner*—Henry A. Bennett

*Attorney, Agent, or Firm*—John L. Parker

[57] ABSTRACT

An air conditioned apron is provided. The apron has an internal apron pocket. An air conditioner including an air blower is mounted within the apron pocket. The air conditioner includes an air duct for conveying air discharged by the blower to the apron pocket and/or to the atmosphere outside the apron. This air duct has a first exit extending outside of the apron through an apron opening, and a second exit within the apron pocket. The flow of air through the first duct exit is selectively controlled to thereby direct flow of air as desired through the second duct exit and into the apron pocket. In this way, the apron pocket may be heated, cooled or ventilated to the extent desired. Various alternatives are disclosed, including rotatable insert and pivotal damper types of control. In some alternatives, the first duct exit is inclined at an approximate 30 degree angle to the vertical. In one modification, this exit is an elongated tube which discharges conditioned air near the face of the apron wearer. The blower intake draws air from outside the apron, or inside the apron pocket, or both. This intake may also be provided with a filter. In other alternatives, the conditioned air is discharged within the apron pocket near its bottom or its top. In one form of the invention, an apron flap is used for control of air flow and also serves as a protective cover for the outside (first) exit of the air duct.

14 Claims, 13 Drawing Figures

FIG. 8
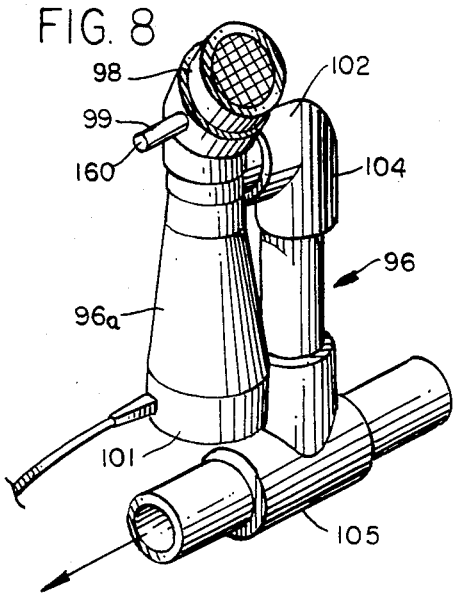
FIG. 9
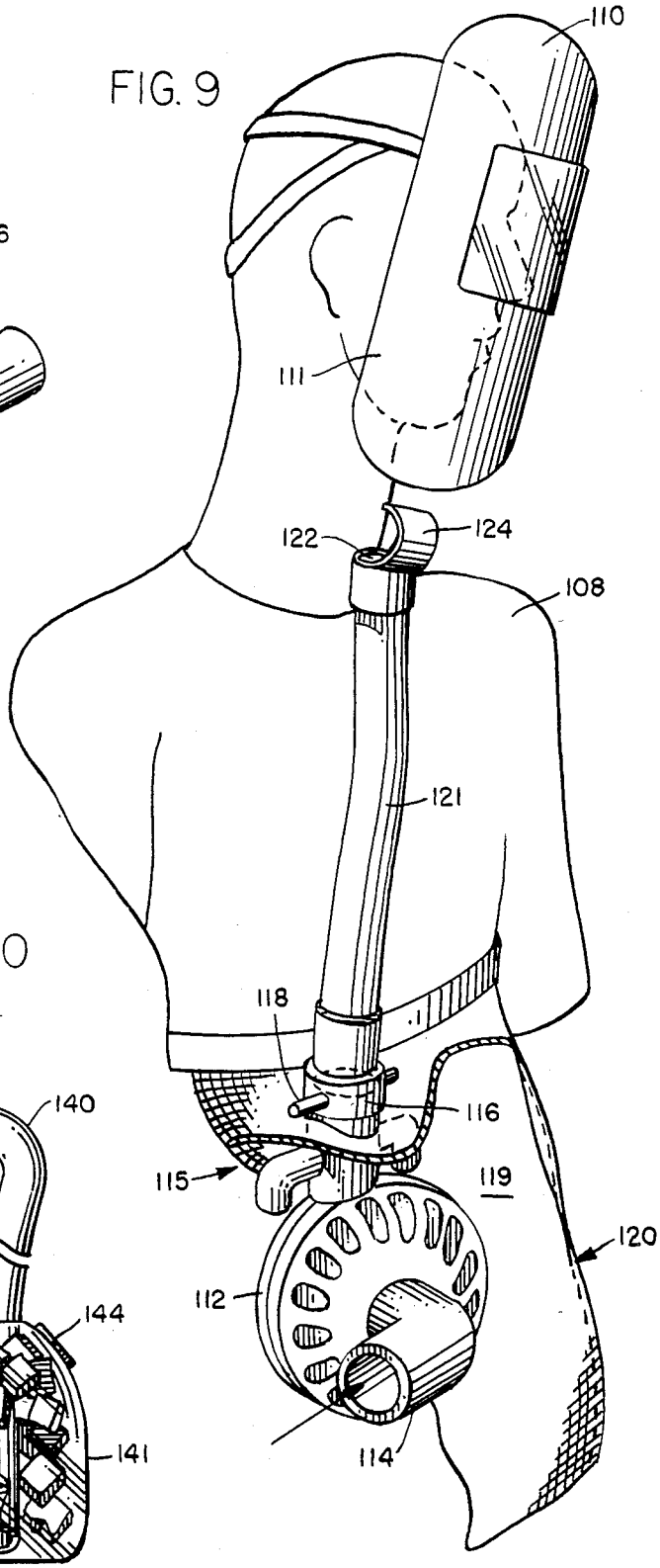
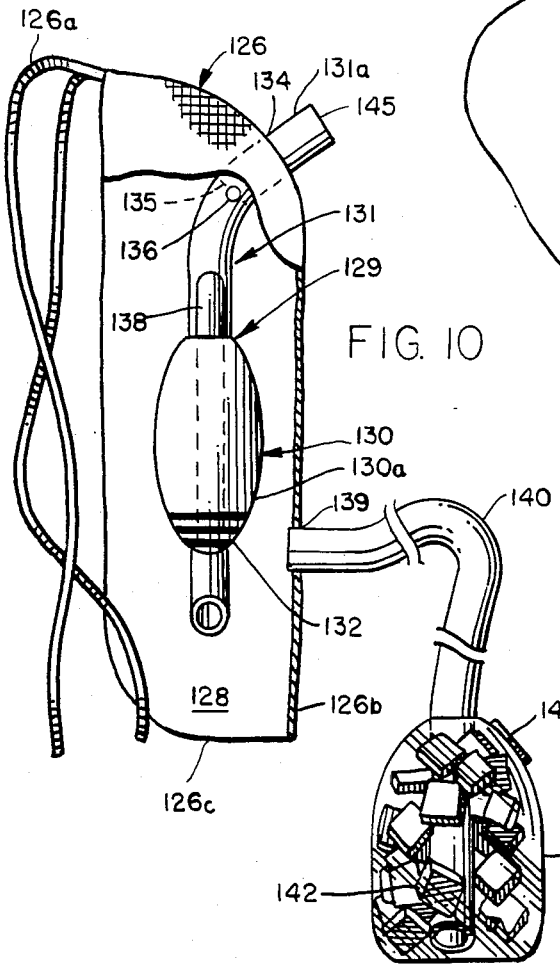
FIG. 10

AIR CONDITIONED APRON

DESCRIPTION OF THE INVENTION

This application is a continuation-in-part of my application Ser. No. 749,501, filed June 27, 1985, now abandoned.

This invention relates generally to aprons, and more particularly, to air conditioned aprons which may be heated, cooled or ventilated as desired.

It is a primary object of my invention to provide an apron including a built-in air conditioner for heating, cooling or ventilating the apron as desired by the person wearing the apron. A related object is to provide such an air conditioned apron in which intake air to the apron may be received from outside, inside, or both inside and outside the apron thereby lending versatility to the applications for my apron.

Another object of the invention is to provide an apron having an air conditioned pouch in which the extent of heating or cooling of the pouch may be quickly and easily controlled by the wearer of the apron by a simple manual adjustment. A related object is to provide such an apron in which temperature control is achieved by adjusting either the air flow or the heat applied or both, to maintain comfort conditions. Still another object of my invention is to provide such an air conditioned apron in which temperature or flow control is achieved by means of a bypass which may be closed or opened to thereby direct air to the apron pouch in whatever quality and quantity desired. Yet another object of the invention is to provide such an apron which may be utilized not only to condition the air within an apron pouch, but which is also useful in providing conditioned (e.g., heated) air to the region around nearby equipment.

Still another object of my invention is to provide an air conditioned apron which is economical to construct and operate, is energy efficient and is maintenance free. Still another object of my invention is to provide an air conditioned apron which is extremely durable and will provide air conditioned comfort to the person wearing the apron in all extremes of weather.

The foregoing and other objects, advantages and functions of the invention will be apparent on reference to the specification and to the attached drawings illustrating preferred embodiments of the invention.

Figure 5:
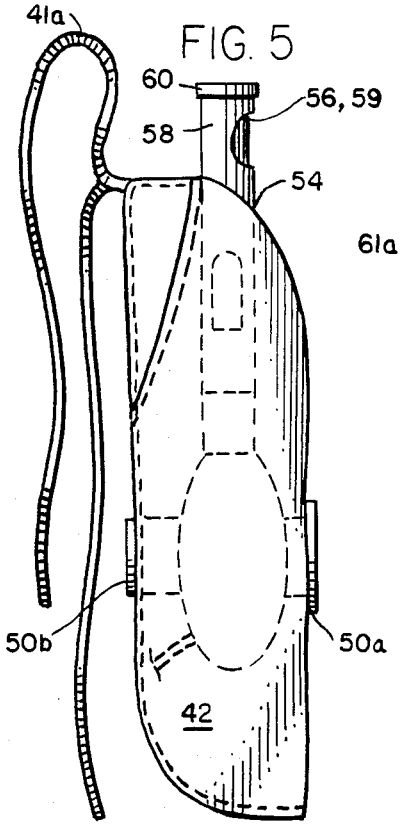
FIG. 5 is a side elevational view of the form of my invention shown in FIG. 4.
Figure 6:
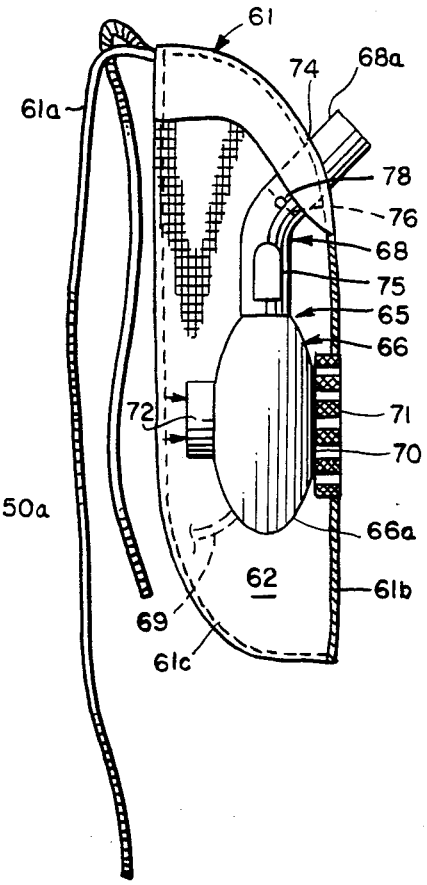
Figure 7:
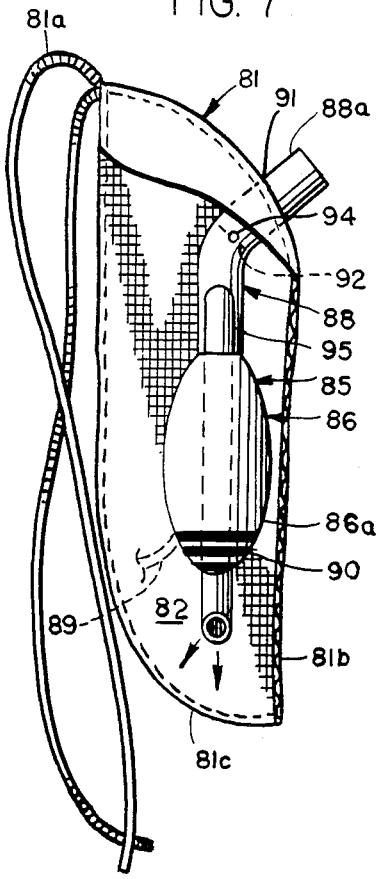

FIGS. 6 and 7 are side elevational views, partly in section, similar to FIG. 5, but in which other modifications of my invention are depicted. In FIG. 6, my invention includes use of a filter on the outside air intake to my air conditioned apron as well as a modified air duct arrangement. FIG. 7 depicts an alternative embodiment of my invention in which a different air circulating arrangement is employed.

FIG. 8 is a perspective view showing a further modified illustrative form of air heater and blower and duct arrangement which may be employed in the air conditioned apron of my invention.

FIG. 9 is a perspective view, partly in section, of still another modified form of my invention in which my air conditioned apron is employed to additionally provide cooling or ventilation to the face mask area of a user.

FIG. 10 is a vertical elevational view, partly in section, of yet another modified form of my invention in which my air conditioned apron is used to bring about cooling rather than heating.

Figure 11:
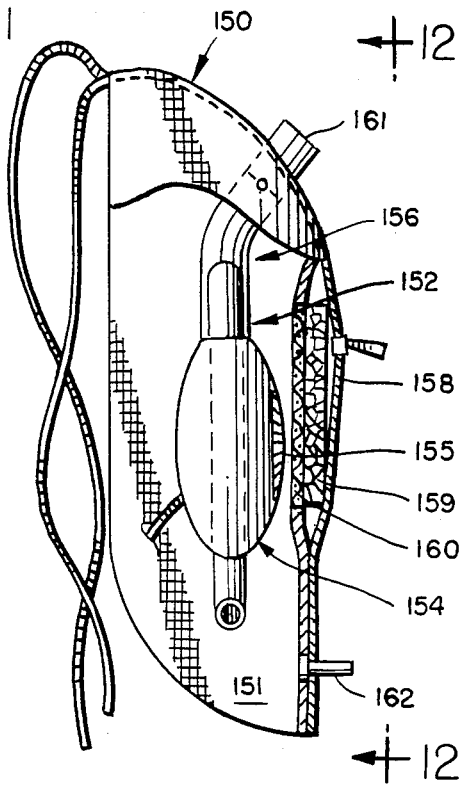

FIG. 11 is a side elevational view, partly in section, of a still further modified form of my air conditioned apron in which a zippered apron pocket is provided for holding a cooling medium.

Figure 12:
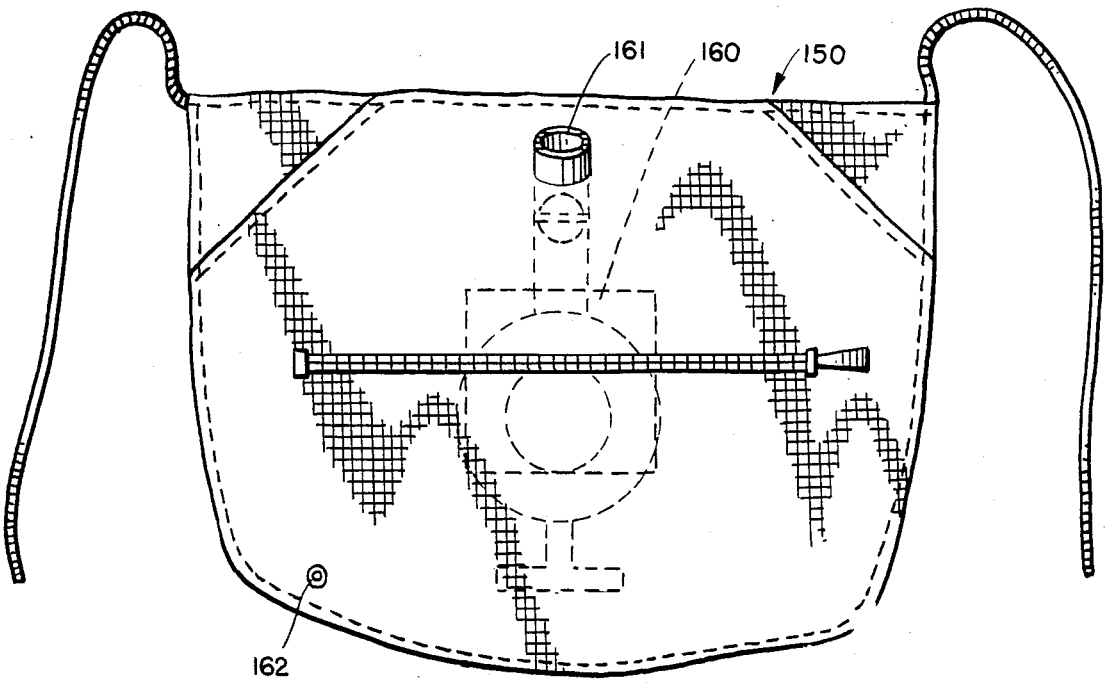

FIG. 12 is a front elevational view of the form of the invention shown in FIG. 11, taken generally along the line 12—12 in FIG. 11.

Figure 13:
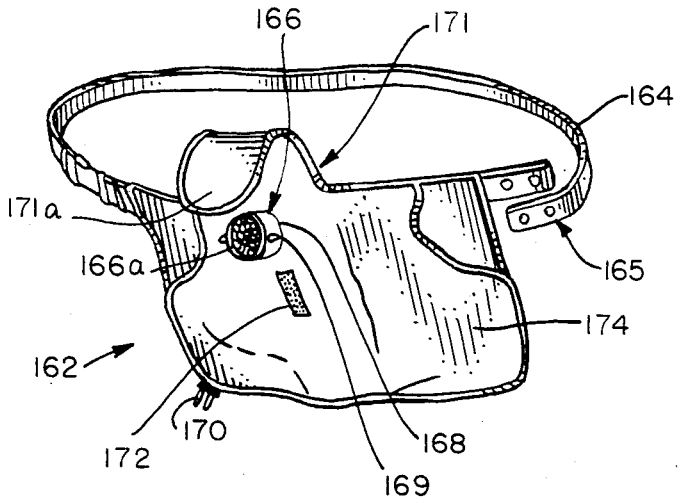

FIG. 13 is a front perspective view of another modified form of my invention in which an apron flap is provided associated with the discharge from the air heater and blower and duct arrangement.

While the invention will be described in connection with certain preferred embodiments, it will be understood that I do not intend to limit the invention to those embodiments. On the contrary, I intend to cover all alternatives, modifications, and equivalents as may be included within the spirit and scope of the invention.

Figure 1:
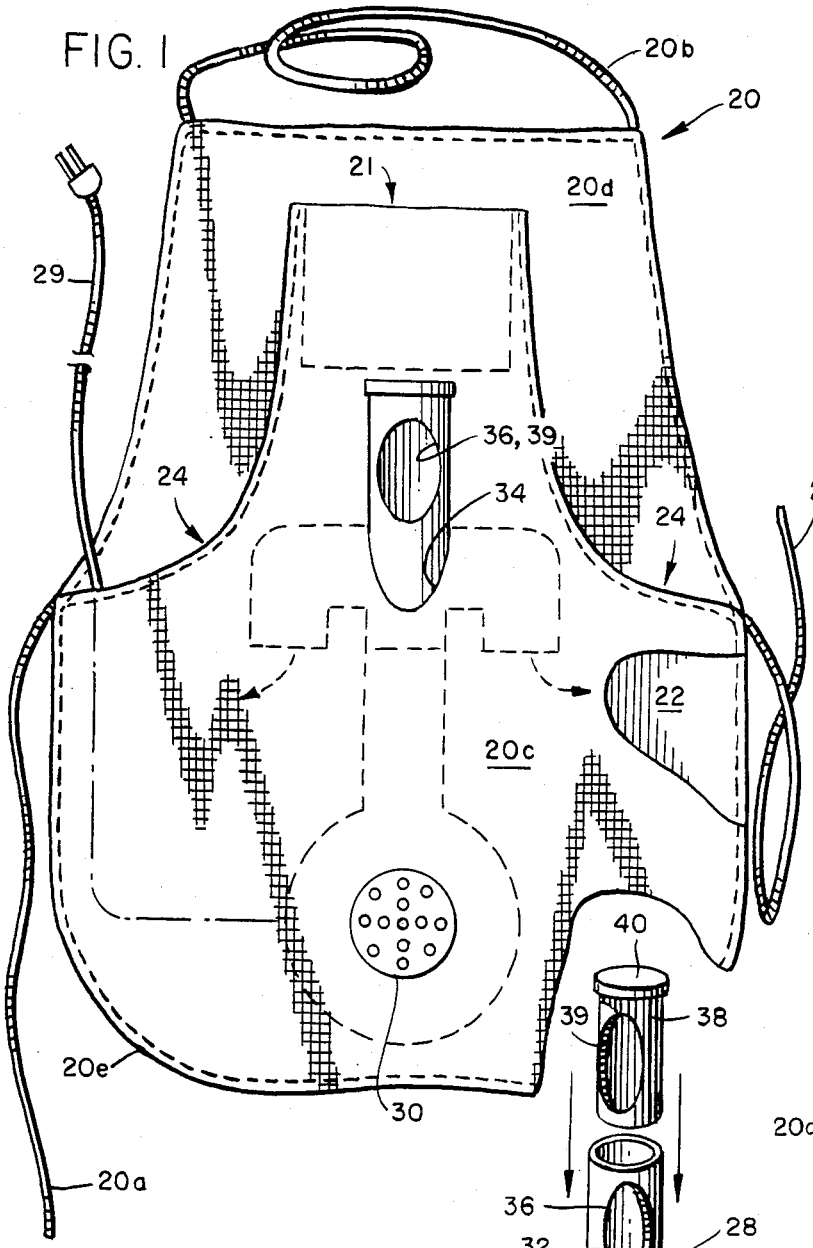
FIG. 1 is a front elevational view of one illustrative form of air conditioned apron (bib type) which may be used in practicing my invention.

Turning now to the drawings, there is shown in FIG. 1 an illustrative bib type apron 20 adapted to be worn by a worker or other user (not shown). Conventional apron strings **20*a* and a neck loop 20*b* are provided for securing the apron to the body of the worker. As shown, the illustrative apron is formed of flexible cloth, plastic or the like and comprises front 20*c* and rear 20*d* panels generally sewn together around their peripheral edges 20*e* to define therebetween one or more apron pouches or pockets 21, 22. As shown, the apron includes a small upper pocket 21 for holding tools or the like, and a larger lower pocket 22 entry to which is gained by way of hand openings 24 provided on either side of the apron (where the panels 20*c* and 20*d* are not sewn together). The openings 24** are arranged such that a worker wearing the apron may readily insert his hands into them as desired.

In carrying out the invention, I provide means 25 for air conditioning the apron located within the lower apron pouch 22, which means comprises an air heater and blower 26 along with an integral air duct arrangement 28. The illustrative air heater and blower 26 is of the flameless type, having an inner heating element (not shown), a forced air blower (not shown) and a blower motor (also not shown) all housed within a casing **26*a*. If desired, an on-off switch (not shown) may be provided on the air heater and blower casing 26*a* for ready manipulation by the wearer of the apron. A suitable electrical cord 29 connects the blower motor to a power source. The blower causes air to be drawn in through a front intake 30 on the casing, and to be discharged through a casing exit 31. Preferably, the heater element may be operated independently of the blower motor so that the blower may be operated with or without heat. The duct arrangement 28 is integrally secured to the casing exit 31** so that air exiting from the blower passes upwardly through the duct arrangement.

As shown, the duct arrangement 28 includes a tubular vertical member 32 joined to the casing exit 31 and extending upwardly through an opening 34 provided in the front panel 20*c* of the apron, and a pair of generally horizontally disposed elbows 35 extending from opposite sides of the member 32 and which discharge downwardly into the pocket cavity 22. As shown, the elbows 35 are located along the mid-portion of the vertical member 32.

Means is provided in the upper portion of the vertical member 32 for adjustably controlling the flow of air through the duct arrangement 28. As shown, this means comprises an oval shaped port or opening 36 in the wall of the upper portion of the vertical member 32 extending outside the apron, and an inner tubular closure member 38 adapted to fit rotatably inside the upper end of the vertical member 32. The inner closure member 38 has an oval shaped port or opening 39 corresponding in size and shape to the port 36 in the member 32, and includes an upper gripping portion 40 for manipulation by the thumb and forefingers of the worker. The member 38 may thus be manually rotated within the member 32 to selectively close or partially close the port 36 as desired. That is, by manipulation of the gripping portion 40 the worker may align the two oval ports 36, 39 to permit full flow of air therethrough, or may rotate the member 38 within member 32 to offset these ports with respect to one another to thereby restrict the flow of air to the extent desired.

Such full or partial closure of the port 36 functions to control the extent and volume of air flow bypassed or diverted outside the apron. Thus, when the ports 36, 39 are aligned and thus unobstructed, most of the air rising through the vertical member 32 from the blower 26 passes out through these ports and into the atmosphere. With the port 36 partially or fully closed, the air moving upwardly through the member 32 no longer is bypassed fully into the atmosphere and is necessarily then diverted downwardly through the elbows 35 and into the inner environs of the apron pocket 22. This means that the volume of the heated air flowing downwardly through the elbows 35 may be selectively controlled to thereby adjust the temperature within the pocket 22 as desired.

In use, the illustrative apron 20 and air conditioning means 25 function as follows. The user, for example a carpenter or serviceman working out-of-doors during cool weather, affixes the apron to his body using the apron strings 20*a* and neck loop 20*b*. Then he plugs the electic cord 29 into an appropriate electrical outlet (not shown) so that electrical power is provided to the air heater and blower 26. The worker may then place his hands through the hand openings 24 and into the large pocket 22 of the apron.

In order to bring warm air into the apron pouch 22, the worker need only start the air heater and blower (for example, by actuating the on-off switch). In this way, relatively cold outer air is drawn from outside the apron in through the front air intake 30 of the heater and blower 26. This air is then warmed by the heater and is forced by the blower through the casing exit 31 and into the air duct arrangement 28. The worker then may, by rotating by hand the tubular closure member 38 within the vertical duct member 32, control the extent of flow of warm air through the arrangement to thereby control the temperature maintained in the pocket 22. Thus, by closing off the port 36 provided in the member 32 (by rotatably manipulating the closure member 38 within the member 32), the worker may direct all or most of the heated air downwardly through the duct elbows 35 and into the pouch or space 22 where the worker's hands may be placed. In this way, the worker may place his hands within the pocket 22 for long enough to warm them up, and then may remove his hands to continue the outdoor work as desired. Later, the worker may re-warm his hands by re-inserting them through the apron hand openings 24 and into the heated pocket 22. This process may be repeated as desired to enable the user to periodically warm up his hands while carrying out chores.

Figure 2:
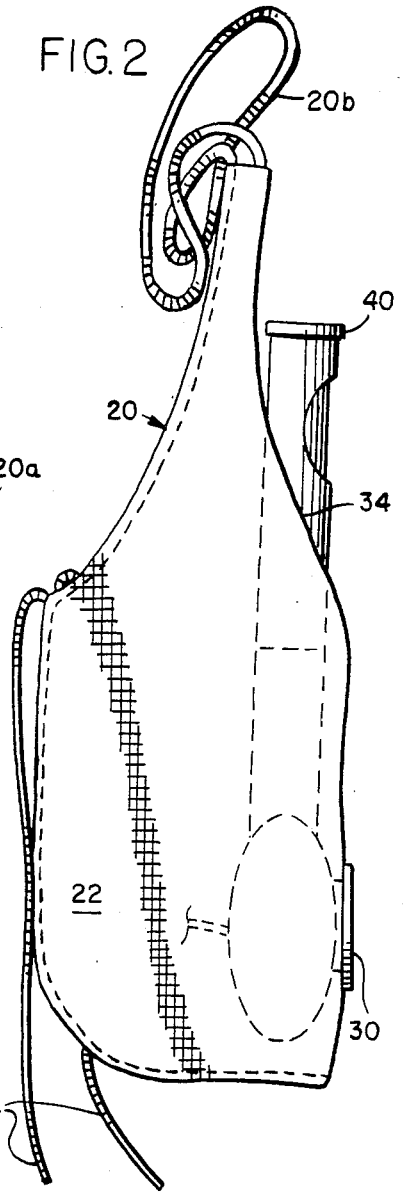
FIG. 2 is a side elevational view of the air conditioned apron depicted in FIG. 1.
Figure 3:
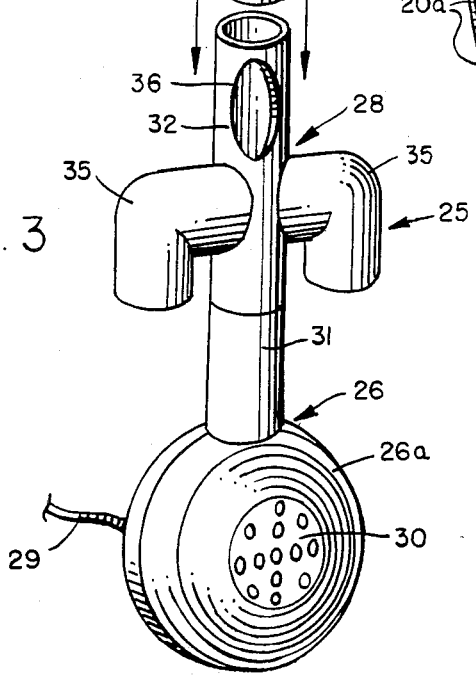
FIG. 3 is a perspective view showing an illustrative air heater and blower and duct arrangement which may be utilized in the air conditioned apron of my invention.
Figure 4:
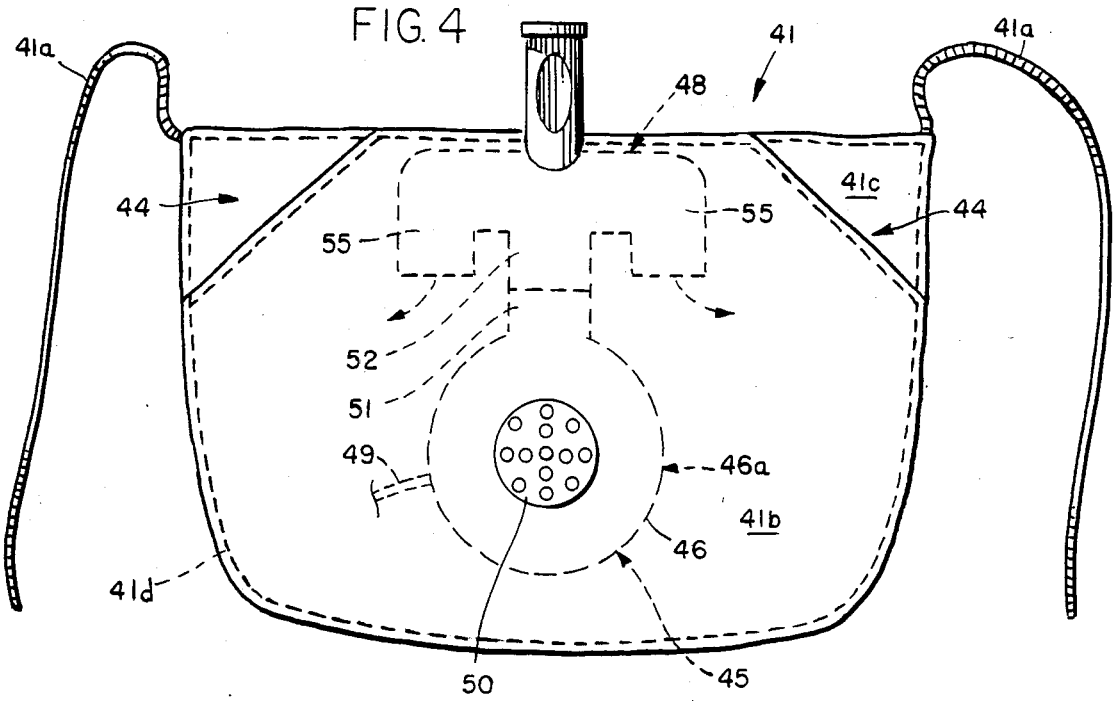
FIG. 4 is a front elevational view of a modified form of my air conditioned apron used with a different type apron (waist type).

Directing attention now to the embodiment of my invention depicted in FIGS. 4 and 5 of the drawings, a different type apron 41 (in this instance, a waist type apron) is shown having apron strings 41*a* and front and rear apron panels 41*b*, 41*c* sewn around their peripheral edges 41*d* so as to define therebetween a large lower pouch or pocket 42. Hand openings 44 are provided for access by the apron wearer to the pouch 42. The illustrative air conditioning means 45 is generally like that shown in FIGS. 1–3. It includes an air heater and blower 46 housed in a casing 46*a*, and an integral air duct arrangement 48. An electrical cord 49 conveys power to the heater and blower 46. Air is drawn into the blower through a front intake 50*a* and, in this instance, a blower rear intake 50*b*. Heated air is then discharged through a casing exit 51, and thence upwardly through the air duct arrangement 48.

In FIGS. 4–5, the duct arrangement includes a tubular vertical member 52 joined to the casing exit 51 and extending upwardly through an appropriate apron opening 54. Once more, a pair of horizontal elbows 55 extend from opposite sides of the vertical member 52 and discharge downwardly into the pocket 42. Adjustable air flow control means is provided in the form of an oval port or opening 56 provided in the wall of the upper portion of the member 52, and an inner tubular closure member 58 which has its own oval shaped port or opening 59 and fits rotatably within the upper end of the member 52. As before, manipulation of the air flow control means is accomplished by the worker gripping an upper portion 60 of the member 58. Functioning of the air flow control means to control the air temperature within the pocket 42 is the same as described in connection with FIGS. 1–3.

Further modified forms of my invention are depicted in FIGS. 6 and 7, which employ different control means for adjusting the air temperature within the apron pocket and have certain other features as described below.

In the embodiment of FIG. 6, I provide a waist type apron 61 having apron strings 61*a* and front 61*b* and rear 61*c* panels suitably joined together to define therebetween an apron pouch or pocket 62. In this instance, air conditioning means 65 is provided including an air heater and blower 66 housed in a casing 66*a*, and an integral air duct arrangement 68. An electrical cord 69 supplies power to the unit 66, and air is drawn into the blower through a front intake 70 and a rear intake 72. A filter 71 is affixed to the front air intake 70 to provide filtration for air entering the heater and blower from outside. In this form of my invention, intake air to the heater and blower 66 comes not only through the outside air intake 70 and filter 71, but through the second air intake 72 located at the rear of the blower and which draws air from the inner pocket 62 itself. This arrangement is more energy efficient to the extent that the resulting partial recirculation of warm air within the pouch reduces the need to heat only relatively cold air from outside.

In the form of my invention shown in FIG. 6, the upper portion 68*a* of the air duct arrangement extends through an apron opening 74 and is tilted forward at an approximate 30 degree angle to the vertical to direct discharged air away from the face of the apron wearer. This is distinguished from the arrangement in FIGS. 1–5 in which the upper portion 46 of the air duct arrangement, i.e., the tubular member 32 (FIGS. 1–3) or 52 (FIGS. 4–5), is vertically aligned with the casing exit 31 or 51 of the air heater and blower 26 or 46. While the air duct arrangement 68 of FIG. 6 includes the same elbow structure 75 as in FIGS. 1–5, a different control means is provided in FIG. 6 for adjusting the air temperature within the apron pocket 62. As shown, a pivotable damper 76 is provided within the upper portion 68*a* of the air duct arrangement, this damper being manually adjustable by way of a knob 78 extending on the outside of the air duct. Thus, a user of my air conditioned apron may control the temperature of the air within the apron pocket 62 by a simple manual opening or closing of the damper 76 to thereby bypass more or less of the heated air to the outdoors instead of to the pocket.

The form of my invention shown in FIG. 7 is similar to that of FIG. 6 insofar as air temperature control is concerned. However, in FIG. 7 discharge of the warmed air is directed into the lower portion of the apron pocket rather than its upper portion (as in FIG. 6). In this way, the warm air which has a natural tendency to rise is forced to start rising from the bottom of the apron pocket thereby providing more warmth within the pocket.

Thus, in the embodiment of FIG. 7 there is shown a waist type apron 81 having apron strings 81*a* and front 81*b* and rear 81*c* panels suitably joined together to define therebetween an apron pouch or pocket 82. The air conditioning mean 85 provided in this embodiment includes an air heater and blower 86 housed in a casing 86*a*. and an integral air duct arrangement 88. An electrical cord 89 supplies power to the unit 86, and air is drawn into the blower through an intake 90 provided in the lower portion of the casing 86*a*. In this form of my invention, as in FIG. 6, an upper portion 88*a* of the air duct arrangement extends through an apron opening 91 and is tilted forward at an approximate 30 degree angle to the vertical to direct discharged air away from the face of the apron wearer. Once more, a damper 92 is provided within the upper portion 88*a* of the air duct arrangement, this damper being manually adjustable by way of a knob 94 extending on the outside of the air duct so that a user of my apron may control the temperature of the air within the apron pocket 82 by manually opening or closing the damper 92 to thereby bypass more or less of the heated air to the outdoors instead of to the pocket. The air duct arrangement 88 of FIG. 7 includes the same elbow structure 95 as in FIG. 6. Thus, in this form of my invention air is circulated within the apron pouch 82 unless the bypass is used.

In FIG. 8 there is illustrated another modified form of air heater and blower which may be used in practicing my invention. In this instance, an illustrative air heater and blower 96 is shown having a casing portion 96*a* to which is attached an upper bypass portion 98 inclined to the vertical and having a damper 99 therewithin operated by a knob 100. In this instance, intake air enters the blower through the bottom 101 of the casing 96*a* and warmed air discharges through an exit 102. The warmed air is then directed into an elbow 104 and tee 105 arrangement which forces the heated air to the lower portion of the apron pocket. When this modification is employed with my invention, the intake air to the heater and blower is drawn exclusively from within the pocket. In this way more efficient utilization of heat results through recirculation of air within the apron.

While there are ample applications of my invention in situations where heating is desired, there are also instances in which cooling rather than heating is preferred. The forms of my invention illustrated in FIGS. 9–12 illustrate various ways in which my air conditioning system may be used to cool or ventilate either the apron itself or the wearer of the apron. In these forms of my invention, the heater portion of the heater and blower is bypassed so that the device functions only as a blower.

In FIG. 9, my invention is illustrated as used in conjunction with a welder 108 or other person wearing an illustrative face mask 110 under circumstances where warm air or gases are likely to be present in the space between the wearer's face 111 and the mask. For example, many times a welder who must wear a face mask will become very uncomfortable, especially in the face and neck area, due to the heat, smoke or other gases generated by the welding equipment (not shown). In such instances, my invention may be used to cool and ventilate the welder's face and thereby render working conditions more comfortable and healthy. As shown here, an illustrative air blower 112 is provided having an air intake elbow 114, and an air discharge duct arrangement 115. The upper portion of the illustrative duct arrangement 115 is provided with a damper 116 and operating knob 118, so that cool air may be diverted as desired from the pouch 119 of the apron 120 upwardly through an upper tube 121 which terminates in an exit opening 122 located near the face 111 of the welder. As shown, the upper end of the tube 121 is provided with a deflection plate or shield 124 which directs cool air exiting through the opening 122 into the space between the worker's face 111 and the mask 110. If desired, the air intake 114 may be filtered or ducted to a remote area (not shown) to obtain pure air as required when working in confined or impure areas. One of the advantageous features of this form of my invention is the general feeling of openness (in contrast to the confined nature of a conventional mask) that is conveyed to the welder by reason of the fresh air flow through and around the entire facial area.

In the embodiment of my invention depicted in FIG. 10, a waist type apron 126 has apron strings 126*a* and front 126*b* and rear 126*c* panels suitably joined together to define therebetween an apron pouch or pocket 128. The air conditioning means 129 provided in this embodiment is like that shown in FIG. 7. Thus, an air blower 130 is provided housed in a casing 130*a*, and an integral air duct arrangement 131 is also provided. Air is drawn into the blower through an intake 132 provided in the lower portion of the casing 130*a*. An upper portion 131*a* of the air duct arrangement extends through an apron opening 134 and is tilted forward at an approximate 30 degree angle to the vertical. A damper 135 is provided within the upper portion 131 of the air duct arrangement, this damper being manually adjustable by way of a knob 136. The air duct arrangement 131 includes the same elbow structure 138 as described previously.

As shown in FIG. 10, an opening 139 is provided in the front panel **126*b* of the apron and to which is affixed an inlet tube 140 connected to a container 141 holding ice or dry ice 142 and having an air inlet 144. The intake air, cooled after passing over the ice 142, passes through the tube 140 and blower 130 and out either a dampered exit 145 or is directed downwardly for recirculation through the apron pouch 128. As a further alternative, a discharge tube (not shown) or the like may be secured to the dampered exit 145** to thereby direct the flow of cool air as desired. For example, it may be desirable to direct this cool exit air upwardly toward the facial portion of the person wearing the apron. Of course, it will be readily understood that any suitable cooling source or medium may be employed in lieu of the particular ice and container shown without adversely affecting the operation or usefulness of my invention.

In the version of my invention depicted in FIGS. 11 and 12, I provide an apron 150 having a pouch 151 including air conditioning means 152 similar in some respects to those shown in FIGS. 6 and 7. As shown in FIGS. 11–12, an air blower 154 is provided having a front air intake 155. Except for this intake 155, the remaining structure of the air duct arrangement 156 is like that shown in FIG. 8. In the embodiment of FIGS. 11–12, a horizontally zippered pocket 158 is provided within the front panel of the illustrative apron 150, which pocket is provided for holding a cooling medium such as dry ice 159. The air intake 155 of the blower 154 is located so as to draw cool air through a screen 160 provided on the interior of the zippered pocket 158, and thus over the dry ice 159. Air flow is by convection through this screen 160, over the cooling medium, and back out through the screen and into the apron pouch 151. The blower 154 thus discharges this cool air either into the lower portion of the apron pouch 151 or upwardly through a dampered upper exit 161. Again, if desired, the air intake 155 may be filtered or ducted to a remote area (not shown) to obtain pure air. As shown in FIG. 11, an auxiliary gas inlet 162 is provided in the lower portion of the apron 150. In this form of the invention, as with several of the others described above, the adjustable damper controls the quantity of bypassed air and therefore the amount of cooling to the pouch.

It will be understood that in some applications, for example where it is desired to create a reservoir of cool (as in the embodiment of FIG. 9) or warm air within the apron pouch, it may be desirable to provide velcro or other fasteners (not shown) for the apron pockets so that they may be sealed.

In some applications it may be desirable to construct the dampered upper exit 161 so that it is directionally adjustable. For example, this may be accomplished by providing this exit with a swivel or articulated joint (not shown). Such an arrangement may enhance the usefulness of my invention by facilitating the direction of heat or cooling toward the frontal area of my apron as, for example, when my apron is used to service equipment. Thus, one of the advantageous features of my invention is that bypassed heated or cooled air, as the case may be, may, upon being discharged into the atmosphere, be directed toward items of equipment to thereby warm or cool such equipment. For example, where welding equipment is employed, it may be advisable to direct cool air out through the bypass of my illustrative air conditioned apron so that such cool air impinges against overheated welding equipment to thereby cool it as necessary.

Turning now to the embodiment of the invention shown in FIG. 13, a waist type apron 162 is provided having an apron belt 164. As shown, the belt 164 is provided with a "quick release" type fastener 165 to facilitate the apron wearer's putting on and taking off the apron. The illustrative air conditioning means provided with this apron may be generally like that of FIGS. 6–8 and 10–12. Thus, the air conditioning means includes an air duct arrangement like, for example, that of FIG. 7, in which an upper portion 166 of the air duct arrangement, having an outer end **166*a*, extends through an apron opening 168 and is tilted forward at an approximate 30 degree angle to the vertical to direct discharged air outwardly from the face of the apron wearer. A damper is located in the upper portion 166 of the air duct arrangement depicted in FIG. 13, with the damper being manually operable by means of a knob 169. An electrical plug 170** is provided in the lower portion of the apron for attachment to an external source of electrical power (not shown) for the air heater and blower.

In this form of the invention, an apron flap 171 is provided, centrally disposed over the outer duct end **166*a*, for use in selectively controlling the flow of air through the duct arrangement. To this end, the underside of the outer or loose end 171*a* of the flap is provided with fastening means (not shown in the drawing), in this instance a velcro strip, which is releasably engageable with a similar velcro strip 172 provided on the apron at a location below the end 166*a* of the air duct. By selectively adjusting the fastening point of the free end 171*a* of the flap, the distance of the flap from the duct end 166*a* may be predetermined as desired so that the flap functions to restrict as desired the outward flow of air from the duct to thereby control the amount of air diverted into the apron pocket 174 (FIG. 13** shows the flap unattached).

Thus, the end **171*a* of the flap may be pulled down tightly over the duct end 166*a* and secured at the lower end of the velcro strip 172 if it is desired to significantly restrict outward flow of air from the duct. This would divert most of the warm air into the apron pocket 174. Alternatively, the end 171*a* of the flap may be secured loosely over the duct end 166*a* by attaching the flap at the upper end of the velcro strip 172**, which would less severely restrict outward flow of air from the duct.

Obviously, this air flow control function of the flap 171 may be utilized either in conjunction with, or independently of, the damper and knob (see 169) if desired. Thus, if desired the damper and knob (169) may be eliminated entirely and the flap 171 used to provide the sole means for selectively controlling the flow of air through the duct arrangement. In this event, the apron wearer would adjust the air temperature as desired within the apron pocket 174 by simply moving the point of attachment of the flap end **171*a* upwardly or downwardly along the velcro fastening strip 172. Such a flap may also be employed in conjunction with, or in addition to, other air control flow means such as that described and illustrated herein in connection with FIGS. 1–5**.

The flip-over and adjustable flap 171 also may serve as a cover for the duct end **166*a* to protect it against the elements when the apron is used out of doors. In this way, the flap 171 prevents rain, snow or dirt from entering the duct end 166*a*** and fouling the internal parts of the air heater and blower arrangement.

My air conditioned apron has a variety of uses. Its use as an industrial apron by tradesmen has been mentioned above. For example, my air conditioned apron may be used as a muff by arthritic patients who must keep their hands warm to avoid pain. Certain athletes, such as baseball pitchers and football quarterbacks, may find my apron useful in keeping their hands warm in between innings or plays.

I claim as my invention:

1. An air conditioned apron comprising, in combination, an apron having an internal apron pocket and including an opening, air conditioning means including an air blower mounted within said apron pocket and having an air intake, said air conditioning means including an air duct for conveying air discharged by said blower, said air duct having a first exit extending outside of said apron through said apron opening and a second exit within said apron pocket, and means associated with said air duct for selectively controlling the flow of air through said first duct exit to thereby direct flow of air as desired through said second duct exit and into the apron pocket.

2. The air conditioned apron defined in claim 1, in which said first duct exit is cylindrical and includes a port in the wall of the duct, and said selective control means for air flowing through the first duct exit includes a cylindrical insert rotatably disposed within said first duct exit and having a port which may be aligned as desired with said duct port to thereby restrict air flow through said ports as desired.

3. The air conditioned apron defined in claim 1, in which the first duct exit includes a pivotable internal damper which may be pivoted as desired to control air flowing therethrough.

4. The air conditioned apron defined in claim 3, in which the first duct exit is inclined at an approximate 30 degree angle to the vertical.

5. The air conditioned apron defined in claim 3, in which the first duct exit is an elongated tube discharging conditioned air near the face of the person wearing the apron.

6. The air conditioned apron defined in claim 1, in which the blower air intake draws intake air from outside the apron.

7. The air conditioned apron defined in claim 1, in which the blower air intake draws intake air from inside the apron.

8. The air conditioned apron defined in claim 1, in which the blower air intake draws intake air from both inside and outside the apron.

9. The air conditioned apron defined in claim 1, in which the blower air intake is provided with a filter.

10. The air conditioned apron defined in claim 1, in which the second exit within the apron pocket is located near the top of the pocket.

11. The air conditioned apron defined in claim 1, in which the second exit within the apron pocket is located near the bottom of the pocket.

12. The air conditioned apron defined in claim 1, in which the means for selectively controlling the flow of air through the first duct exit comprises an apron flap associated with said exit and means for securing the flap end tightly or loosely as desired over said exit to thereby control air flowing therethrough.

13. The air conditioned apron defined in claim 2, in which the means for selectively controlling the flow of air through the first duct exit also includes an apron flap associated with said exit and means for securing the flap end tightly or loosely as desired over said exit to thereby control air flowing therethrough.

14. The air conditioned apron defined in claim 3, in which the means for selectively controlling the flow of air through the first duct exit also includes an apron flap associated with said exit and means for securing the flap end tightly or loosely as desired over said exit to thereby control air flowing therethrough.

* * * * *